US009089192B1

(12) United States Patent
Holst

(10) Patent No.: US 9,089,192 B1
(45) Date of Patent: Jul. 28, 2015

(54) FASHION ACCESSORY WITH MODIFIABLE APPEARANCE

(71) Applicant: Brittany Holst, Sioux City, IA (US)

(72) Inventor: Brittany Holst, Sioux City, IA (US)

( * ) Notice: Subject to any disclaimer, the term of this patent is extended or adjusted under 35 U.S.C. 154(b) by 51 days.

(21) Appl. No.: 13/710,669

(22) Filed: Dec. 11, 2012

(51) Int. Cl.

| | |
|---|---|
| ***A44C 5/00*** | (2006.01) |
| ***A44C 27/00*** | (2006.01) |
| ***A44C 7/00*** | (2006.01) |
| ***A44C 9/00*** | (2006.01) |

(52) U.S. Cl.
CPC ..... *A44C 5/0084* (2013.01); *A44C 5/003* (2013.01); *A44C 5/0007* (2013.01); *A44C 7/00* (2013.01); *A44C 9/00* (2013.01); *A44C 27/00* (2013.01)

(58) Field of Classification Search
CPC ..... A44C 5/00; A44C 5/0084; A44C 5/12; A44C 11/00; A44C 15/00; A44C 25/00; A44C 5/0007
USPC ..... 16/1.11, 3, 33, 40; 63/1.11, 3, 33, 40, 63/21
See application file for complete search history.

(56) References Cited

U.S. PATENT DOCUMENTS

| | | | | | |
|---|---|---|---|---|---|
| 1,691,445 | A | * | 11/1928 | Meliodon | 63/1.18 |
| 1,978,168 | A | * | 10/1934 | Reid | 63/3 |
| D145,318 | S | * | 7/1946 | Lowenst | D11/2 |
| 2,954,620 | A | * | 10/1960 | Schneider | 40/633 |
| 4,087,989 | A | * | 5/1978 | Taran | 63/11 |
| 4,697,436 | A | * | 10/1987 | Schmidt | 63/3 |
| 4,753,086 | A | * | 6/1988 | Schmidt | 63/3 |
| 4,757,926 | A | * | 7/1988 | Leo | 224/178 |
| 4,905,879 | A | * | 3/1990 | Piccone | 224/173 |
| 5,343,608 | A | * | 9/1994 | MacDonald | 29/450 |
| D398,878 | S | | 9/1998 | Middleton, Sr. | |
| 5,857,217 | A | * | 1/1999 | Hsueh | 2/170 |
| 6,023,786 | A | * | 2/2000 | Burnett | 2/170 |
| 6,560,993 | B1 | | 5/2003 | Bosque et al. | |
| D568,198 | S | | 5/2008 | Pilkin | |
| D658,528 | S | | 5/2012 | Rafaelian | |
| 8,225,626 | B1 | * | 7/2012 | Blau | 63/11 |
| 8,668,080 | B1 | * | 3/2014 | Kazanchyan et al. | 206/6.1 |
| 2002/0043077 | A1 | * | 4/2002 | Boyadjian | 63/3 |
| 2003/0101746 | A1 | | 6/2003 | Bosque et al. | |
| 2005/0229635 | A1 | * | 10/2005 | Peterson | 63/3 |
| 2007/0261439 | A1 | * | 11/2007 | Moy | 63/3 |
| 2009/0151052 | A1 | * | 6/2009 | Masutani | 2/244 |
| 2010/0047604 | A1 | | 2/2010 | Stratton-Metzger | |
| 2010/0236287 | A1 | * | 9/2010 | Summerford | 63/1.12 |
| 2013/0074545 | A1 | * | 3/2013 | Moloney | 63/3.1 |

FOREIGN PATENT DOCUMENTS

| | | | | |
|---|---|---|---|---|
| CH | 674125 | A5 * | 5/1990 | A44C 5/00 |

* cited by examiner

*Primary Examiner* — Emily Morgan
(74) *Attorney, Agent, or Firm* — Luke C. Holst

(57) ABSTRACT

The present invention relates to fashion accessories, particularly wherein the exterior surface appearance may be optionally modified to create an unlimited possibility of looks to be used with a variety of outfits. The purpose of the invention is to provide individuals with an inexpensive piece of jewelry that is adjustable in size and offers a diverse range of appearance options in various colors, fabrics, materials, and ornamental designs.

20 Claims, 3 Drawing Sheets

FASHION ACCESSORY WITH MODIFIABLE APPEARANCE

FIELD OF THE INVENTION

The present invention relates to fashion accessories, particularly of costume jewelry. The purpose of the invention is to provide individuals with an inexpensive piece of jewelry that is adjustable in size and offers a diverse range of appearance options in various colors, fabrics, materials, and ornamental designs.

BACKGROUND OF THE INVENTION

Fashion accessories comprising jewelry, such as bracelets, bangles, rings, earrings, and necklaces, enhance and individualize the appearance of a person and their clothing. Typically, an individual purchases a piece of jewelry for its color, texture, or ornamental design to complement an article of clothing for a specific appearance. Thus, the individual may have a number of different necklaces, bangles, rings, earrings, or bracelets to wear with a particular item of clothing for various occasions. Moreover, current jewelry designs typically do not allow for the article of jewelry to be adjustable to fit different individuals with their own unique shapes and sizes.

The individual costs of costume jewelry may be relatively low, as compared with precious metals and stones. However, because of the need for additional styles, colors, or designs, overall costs can multiply as more articles of costume jewelry are acquired. As more articles of jewelry are acquired additional storage space is needed, resulting in an overall loss of space and/or necessitating further costs in purchasing larger jewelry boxes. Storage space may also be a particular issue when traveling with limited space inside a purse, luggage, or bag. Thus, what is needed is a single fashion accessory wherein the exterior surface appearance (e.g., the color, texture, material, or design) may be optionally modified to create an unlimited possibility of looks to be used with a variety of outfits. What is also needed is an easily adjustable design to allow the article of jewelry to fit an individual's unique shape and size.

SUMMARY OF THE INVENTION

Therefore, it is a principal object, feature, and/or advantage of the present invention to overcome the aforementioned deficiencies in the art and provide a fashion accessory wherein the exterior surface may be optionally modified to create an unlimited possibility of appearances.

Another object, feature, and/or advantage of the present invention is to provide an easily adjustable design that allows for the fashion accessory to fit an individual's unique shape and size.

A further object, feature, and/or advantage of the present invention is to provide a fashion accessory which may be easily placed on or removed from an individual and reused.

Another object, feature, and/or advantage of the present invention is to provide a fashion accessory whose appearance may be modified to allow an individual to save space in a jewelry box, purse, luggage, or bag by not having to purchase additional articles of jewelry to complete unique looks.

A still further object, feature, and/or advantage of the present invention is to provide a fashion accessory which may be low cost and easy to manufacture.

Another object, feature, and/or advantage of the present invention is to provide inexpensive, changeable in appearance necklaces, bangles, rings, earrings, or bracelets, and wherein the change from one appearance to another may be effected with minimal effort, time, and cost.

Another object, feature, and/or advantage of the present invention is to provide a fashion accessory that may be modified to incorporate baby care products and/or provide storage for items (e.g., credit cards, bills, coins, keys, or make-up items).

Yet another object, feature, and/or advantage of the present invention is to provide a method of fashion accessorizing an article of jewelry.

These and/or other objects, features, and/or advantages of the present invention will be apparent to those skilled in the art. The present invention is not to be limited to or by these objects, features, and advantages. No single aspect need provide each and every object, feature, or advantage.

According to one aspect of the present invention, a fashion accessory such as a bracelet, necklace, bangle, earring, or ring is formed with a curved C-shaped interior body having a first end and a second end. The body may be comprised of various materials in accordance with the preference of the wearer, such as metal, wood, stone, leather, and/or plastic. The body should be semi-rigid yet flexible enough to be adjusted to fit different individuals with their own unique shapes and sizes. Upon the body a tubular sleeve is placed, the sleeve extending around and covering a central portion of the C-shaped interior body. The sleeve is interchangeable with other sleeves that may be comprised of different fabrics, plastics, materials, colors, ornaments, and/or surface textures. Thus, the wearer of the fashion accessory may substitute one sleeve for another, as desired, to produce unique visual effects due to the varying textures, colors, materials, ornaments, or designs of the interchangeable sleeves.

According to another aspect of the present invention a fashion accessory such as the one described above is utilized. However, a sleeve is modified to include a pouch with a fastening device (e.g., zipper, button, magnet, or clip) for holding items such as credit cards, bills, coins, keys, or make-up items. Another sleeve may also incorporate a baby care product, such as a baby pacifier, attached to the sleeve to allow a mother to wear a fashionable device that is also practical in tending to a newborn. A sleeve may be further modified to attach to another article of jewelry, such as a bracelet attached to a ring by leather cords or small chains, for creating additional unique visual effects.

According to a further aspect of the present invention a method of fashion accessorizing an article of jewelry is provided. The method includes providing an article of jewelry, such as a bracelet, necklace, bangle, earring, or ring, having a curved C-shaped interior body with a first end and a second end. A plurality of interchangeable tubular sleeves comprised of different fabrics, plastics, materials, colors, ornaments, and/or surface textures is also provided. The method further includes placing a first tubular sleeve from the plurality of interchangeable tubular sleeves upon the body so that the first tubular sleeve extends around and covers a central portion of the body. The first tubular sleeve may be removed from the body and interchanged with other tubular sleeves of the plurality of interchangeable tubular sleeves, to substitute one tubular sleeve for another as desired by the wearer to produce unique visual effects.

Different embodiments may meet different objects of the invention. Other objectives and advantages of this invention will be more apparent in the following detailed description taken in conjunction with the figures. The present invention is not to be limited by or to these objects.

DESCRIPTION OF FIGURES

FIG. 1 is a view of a fashion accessory with a tubular sleeve placed thereon.

FIG. 2 is a view of a fashion accessory wherein the sleeve of FIG. 1 has been substituted with another to produce a unique visual effect.

FIG. 3 is a view of a fashion accessory with a tubular sleeve comprising a pouch with a fastening device.

FIG. 4 is a view of a fashion accessory with a tubular sleeve comprising a baby care product.

FIG. 5 is a view of a fashion accessory with a modified tubular sleeve.

DETAILED DESCRIPTION OF THE INVENTION

Figure 1:
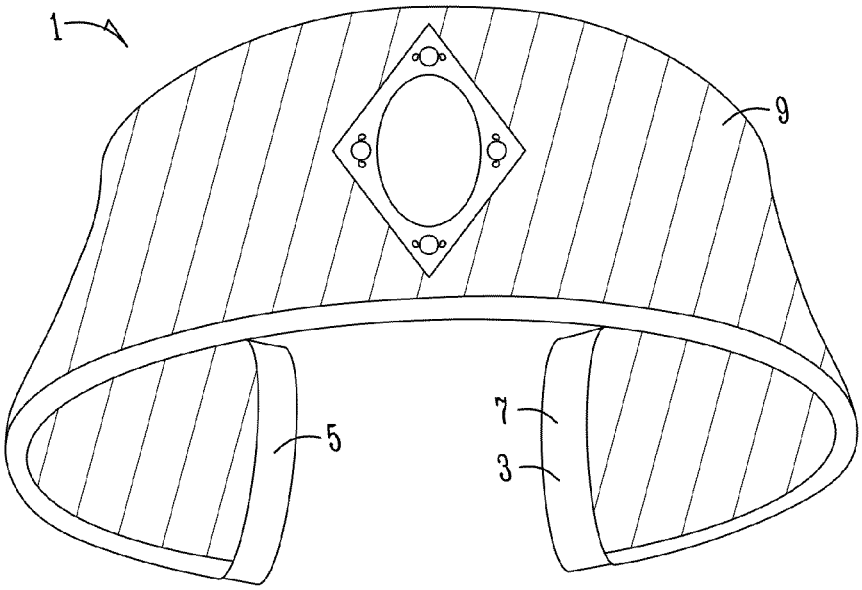
FIGS. 1-5 represent examples of fashion accessories of the present invention.

FIG. 1 illustrates one aspect of a fashion accessory (1), which may be a bracelet, bangle, ring, earring, necklace, or the like, depending on its size. The fashion accessory (1) has a curved C-shaped interior body (3) having a first end (5) and a second end (7). The body (3) may be comprised of various materials in accordance with the preference of the wearer, such as metal, wood, stone, leather, and/or plastic. The body (3) should be semi-rigid yet flexible enough to be adjustable to fit different individuals with their own unique shapes and sizes, by bending the body (3) into the desirable fit. A tubular sleeve (9) is placed upon the body (3) by threading the first end (5) of the body (3) through an opening in the tubular sleeve (9) and sliding the tubular sleeve (9) around the body (3) so that the tubular sleeve (9) covers a central portion of the body (3). The first end (5) and the second end (7) of the body (3) extend from and are not covered by the tubular sleeve (9). The tubular sleeve (9) on the body (3) is interchangeable with other sleeves that may be comprised of different fabrics, plastics, materials, colors, ornaments, and/or surface textures. Thus, the wearer of the fashion accessory (1) may substitute one sleeve for another, as desired, to produce unique visual effects due to the varying textures, colors, ornaments, or designs of the interchangeable sleeves. This allows the wearer to lower costs by not having to acquire entirely separate articles of jewelry to complete unique looks, and further conserves limited space in a wearer's jewelry box, purse, or luggage.

Figure 2:
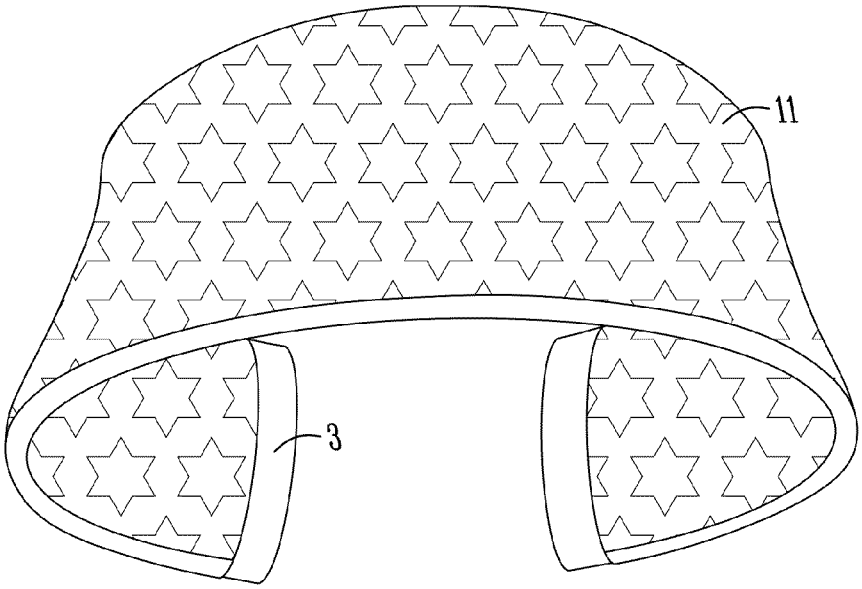

FIG. 2 illustrates the fashion accessory (1) of FIG. 1, wherein a different tubular sleeve (11) has been placed upon the body (3) to demonstrate that sleeves are interchangeable with other sleeves and may be comprised of different fabrics, plastics, materials, colors, ornaments, and/or surface textures, according to the preference of the wearer.

Figure 3:
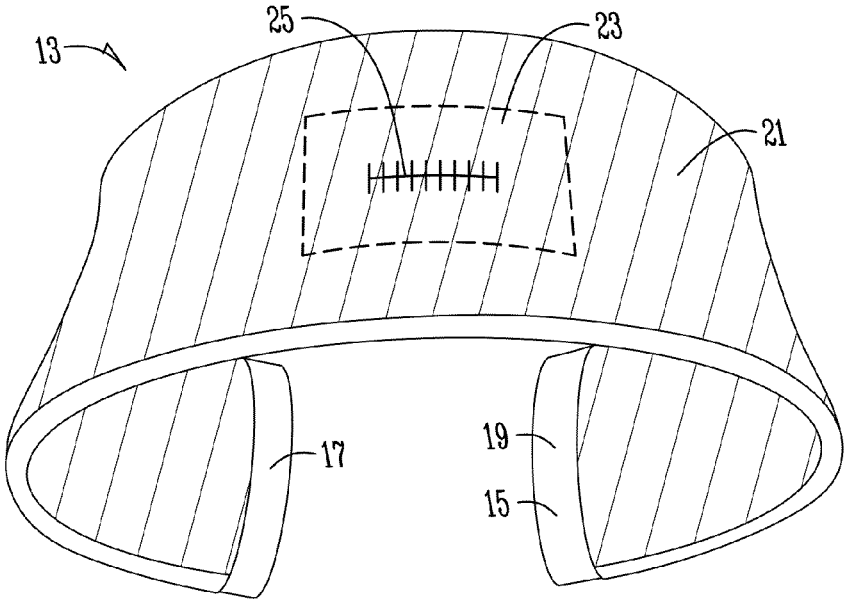

FIG. 3 illustrates yet a further aspect of a fashion accessory (13) of the present invention. As in FIG. 1, the fashion accessory (13) may be a bracelet, bangle, ring, earring, necklace, or the like. The fashion accessory (13) has a curved C-shaped interior body (15) having a first end (17) and a second end (19). The body (15) may be comprised of various materials in accordance with the preference of the wearer, such as metal, wood, stone, leather, and/or plastic. The body (15) should be semi-rigid yet flexible enough to be adjustable to fit different individuals with their own unique shapes and sizes, by bending the body (15) into the desirable fit. A tubular sleeve (21) is placed upon the body (15) by threading the first end (17) of the body (15) through an opening in the tubular sleeve (21) and sliding the tubular sleeve (21) around the body (15) so that the tubular sleeve (21) covers a central portion of the body (15). The first end (17) and the second end (19) of the body (15) extend from and are not covered by the tubular sleeve (21). The tubular sleeve (21) on the body (15) further includes a pouch (23) for holding items, such as credit cards, bills, coins, keys, or make-up items. Such items are held within the pouch (23) and accessed through means of a fastener (25), such as a zipper, button, magnet, clip, or the like.

Figure 4:
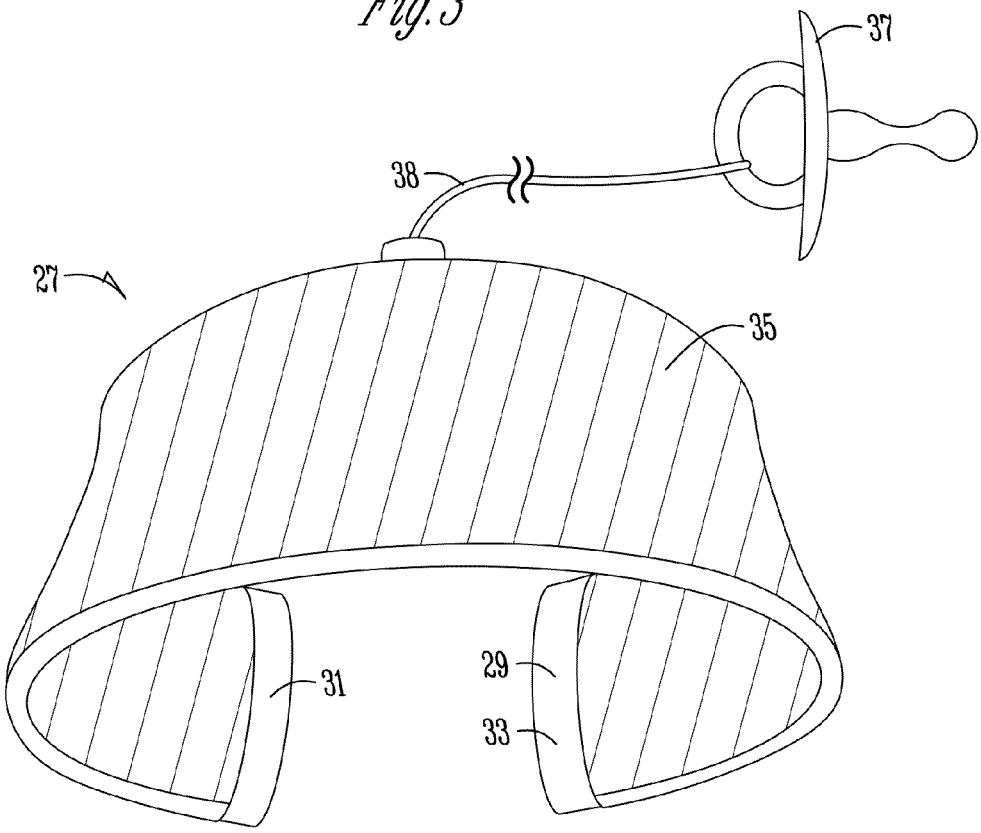

Another aspect of a fashion accessory (27) of the present invention is illustrated in FIG. 4. As in FIGS. 1 and 3, the fashion accessory (27) may be a bracelet, bangle, ring, earring, necklace, or the like. The fashion accessory (27) has a curved C-shaped interior body (29) having a first end (31) and a second end (33). The body (29) may be comprised of various materials in accordance with the preference of the wearer, such as metal, wood, stone, leather, and/or plastic. The body (29) should be semi-rigid yet flexible enough to be adjustable to fit different individuals with their own unique shapes and sizes, by bending the body (29) into the desirable fit. A tubular sleeve (35) is placed upon the body (29) by threading the first end (31) of the body (29) through an opening in the tubular sleeve (35) and sliding the tubular sleeve (35) around the body (29) so that the tubular sleeve (35) covers a central portion of the body (29). The first end (31) and the second end (33) of the body (29) extend from and are not covered by the tubular sleeve (35). The tubular sleeve (35) on the body (29) further includes a baby care product (37), such as a baby pacifier, toy, feeding tool, teething ring, rattle, or a pouch for holding baby related items. A means for attaching the baby care product (37) to the tubular sleeve (35) is also provided, wherein the means for attachment (38) may include a string, cord, chain, clip, strap, snap, or the like.

Figure 5:
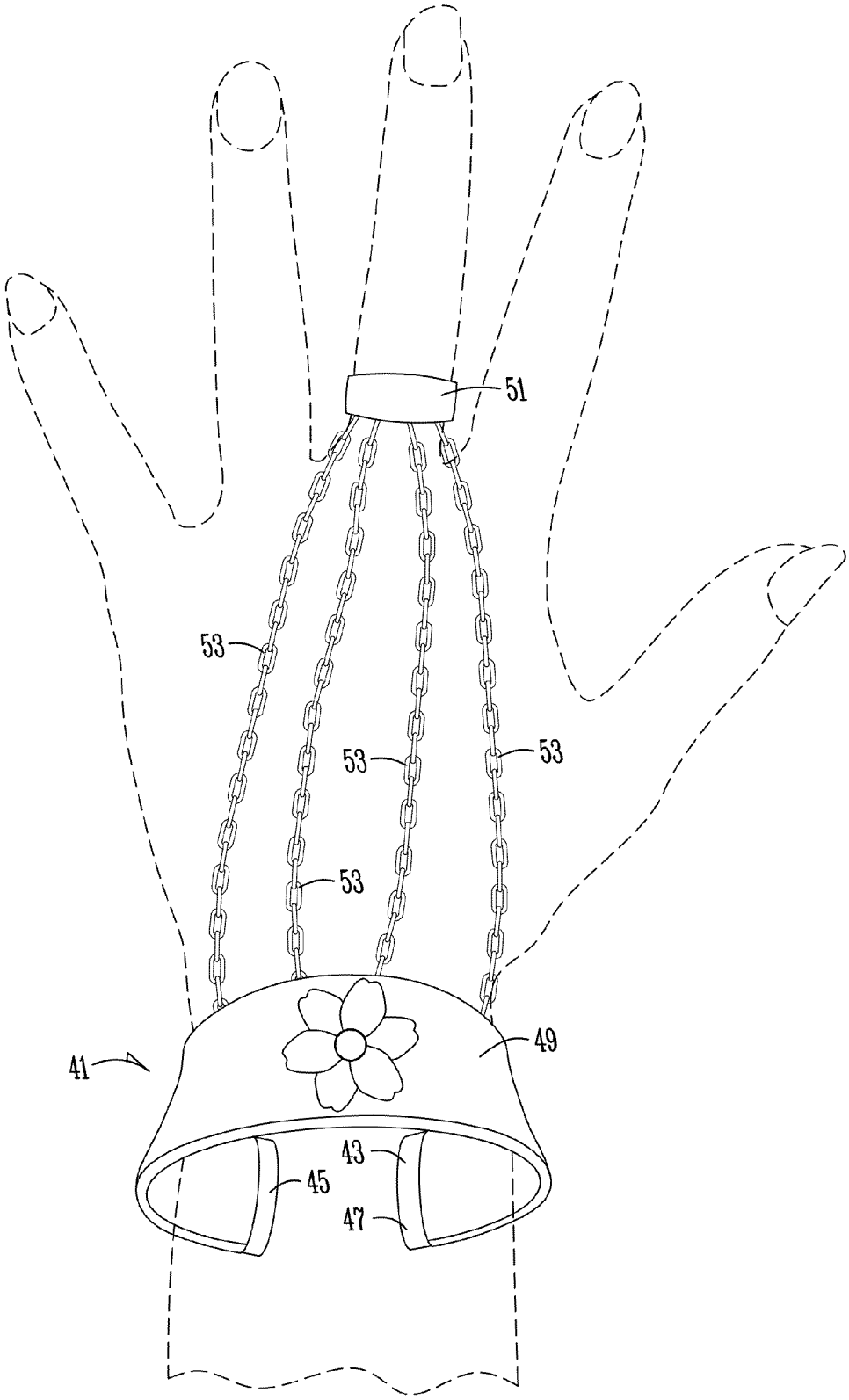

FIG. 5 illustrates another aspect of a fashion accessory (41) of the present invention. As in FIGS. 1, 3, and 4, the fashion accessory (41) may be a bracelet, bangle, ring, earring, necklace, or the like. The fashion accessory (41) has a curved C-shaped interior first body (43) having a first end (45) and a second end (47). The first body (43) may be comprised of various materials in accordance with the preference of the wearer, such as metal, wood, stone, leather, and/or plastic. The first body (43) should be semi-rigid yet flexible enough to be adjustable to fit different individuals with their own unique shapes and sizes, by bending the first body (43) into the desirable fit. A tubular sleeve (49) is placed upon the first body (43) by threading the first end (45) of the first body (43) through an opening in the tubular sleeve (49) and sliding the tubular sleeve (49) around the first body (43) so that the tubular sleeve (49) covers a central portion of the first body (43). The first end (45) and the second end (47) of the first body (43) extend from and are not covered by the tubular sleeve (49). The tubular sleeve (49) on the first body (43) is connected to a second body (51) comprising a bracelet, bangle, ring, earring, necklace, or the like. The tubular sleeve (49) may be connected to the second body (51) by connectors (53) comprising chains, cords, leather, straps, fabrics, ties, and/or the like.

According to a still further aspect of the present invention a method of fashion accessorizing an article of jewelry is provided. The method includes providing an article of jewelry, such as a bracelet, necklace, bangle, earring, or ring, having a curved C-shaped body with a first end and a second end. A plurality of interchangeable tubular sleeves is also provided, wherein the plurality of interchangeable tubular sleeves may be comprised of different fabrics, plastics, materials, colors, ornaments, and/or surface textures. The method further includes placing a first tubular sleeve from the plurality of interchangeable tubular sleeves upon the body by threading the first end of the body through an opening in the first tubular sleeve and sliding the first tubular sleeve around the body so that the first tubular sleeve covers a central portion of the body. The first end and the second end of the body extend from and are not covered by the first tubular sleeve. The first tubular sleeve is then removed, and may be interchanged with other tubular sleeves of the plurality of interchangeable tubular sleeves, to substitute one tubular sleeve for another as desired by the wearer to produce unique visual effects.

Although the invention has been described and illustrated with respect to different aspects thereof, it is not to be so limited since changes and modifications may be made therein which are within the full intended scope of the invention.

What is claimed is:

1. A fashion accessory, comprising:

a plurality of interchangeable tubular sleeves, wherein a first tubular sleeve of the plurality of interchangeable tubular sleeves has an opening at opposite ends of the first tubular sleeve;

a curved C-shaped interior body;

the curved C-shaped interior body consisting of a single piece shaped to form a first end, a second end, and a central portion connecting the first end and the second end;

the curved C-shaped interior body terminating at the first end and second end, wherein the first end and second end are free without additional structure attached to the ends;

the curved C-shaped interior body being semi-rigid and adjustable to fit different individuals with unique shapes and sizes;

the first tubular sleeve fitting slidably around and covering the central portion of the curved C-shaped interior body while leaving the first end and the second end of the curved C-shaped interior body uncovered and exposed;

wherein the first tubular sleeve is placed upon the curved C-shaped interior body by threading the first end of the curved C-shaped interior body through either opening in the first tubular sleeve and sliding the first tubular sleeve around the curved C-shaped interior body;

wherein the first tubular sleeve is interchangeable on the curved C-shaped interior body with other tubular sleeves of the plurality of interchangeable tubular sleeves;

wherein the plurality of interchangeable sleeves are slidably removable over the first end and the second end of the curved C-shaped interior body and reusable; and wherein the first end and the second end of the curved C-shaped interior body are spaced apart when worn by an individual.

2. The fashion accessory of claim 1, wherein the curved C-shaped interior body is adjustable by bending the body into the desired fit.

3. The fashion accessory of claim 2, wherein the curved C-shaped interior body is comprised of metal, wood, stone, leather, plastic, and/or any combination thereof

4. The fashion accessory of claim 3, wherein the plurality of interchangeable tubular sleeves are comprised of different fabrics, plastics, materials, colors, ornaments, and/or surface textures.

5. The fashion accessory of claim 4, wherein the fashion accessory is selected from the group consisting of a bracelet, bangle, ring, earring, and necklace.

6. The fashion accessory of claim 4, wherein the fashion accessory is a bracelet.

7. The fashion accessory of claim 4, wherein the first tubular sleeve comprises a pouch for holding items and a fastener for accessing and holding items within the pouch.

8. The fashion accessory of claim 7, wherein the fastener is selected from the group consisting of a zipper, button, magnet, and clip.

9. The fashion accessory of claim 4, wherein the first tubular sleeve comprises a baby care product and a means for attaching the baby care product to the first tubular sleeve.

10. The fashion accessory of claim 9, wherein the baby care product comprises a baby pacifier, toy, feeding tool, teething ring, rattle, and/or a pouch for holding baby related items.

11. The fashion accessory of claim 10, wherein the means of attaching the baby care product to the first tubular sleeve comprises a string, cord, chain, clip, strap, and/or any combination thereof.

12. The fashion accessory of claim 4, further comprising:

a second body, wherein the second body is selected from the group consisting of a bracelet, bangle, ring, earring, and necklace;

wherein the first tubular sleeve on the curved C-shaped interior body is connected to the second body by a connector.

13. The fashion accessory of claim 12, wherein the connector is chains, cords, leather, straps, fabrics, ties, and/or any combination thereof.

14. A fashion accessory, comprising:

a plurality of interchangeable tubular sleeves, wherein a first tubular sleeve of the plurality of interchangeable tubular sleeves has an opening at opposite ends of the first tubular sleeve;

an interior body;

the interior body comprising a monolithic piece shaped to form a first end, a second end, and a central portion connecting the first end and the second end;

the interior body terminating at the first end and the second end in a C-shape, wherein the first end and the second end are spaced apart without additional structure attached to the ends;

the first tubular sleeve fitting slidably around and covering the central portion of the interior body while leaving the first end and the second end of the interior body uncovered and exposed;

wherein the first tubular sleeve is interchangeable on the interior body with other tubular sleeves of the plurality of interchangeable tubular sleeves; and wherein the plurality of interchangeable tubular sleeves are reusable.

15. The fashion accessory of claim 14, wherein the interior body is adjustable by bending the body into the desired fit.

16. The fashion accessory of claim 15, wherein the interior body is comprised of metal, wood, stone, leather, plastic, and/or any combination thereof

17. The fashion accessory of claim 16, wherein the plurality of interchangeable tubular sleeves are comprised of different fabrics, plastics, materials, colors, ornaments, and/or surface textures.

18. The fashion accessory of claim 17, wherein the fashion accessory is selected from the group consisting of a bracelet, bangle, ring, earring, and necklace.

19. A fashion accessory, comprising:

a first end of the fashion accessory;

a second end of the fashion accessory;

a central portion of the fashion accessory between the first end and the second end of the fashion accessory;

a curved C-shaped body forming the first end of the fashion accessory, the second end of the fashion accessory, and the central portion of the fashion accessory, the curved C-shaped body consisting of a material formed into a curved C-shape such that the first end of the fashion accessory and the second end of the fashion accessory are spaced apart from each other;

a first tubular sleeve sized to fit slidably around the curved C-shaped body and to cover the central portion of the curved C-shaped body, the first tubular sleeve having a first opening at a first end and a second opening at a second end;

wherein the first tubular sleeve is positioned over the curved C-shaped body by threading the first end of the curved C-shaped body through either opening in the first tubular sleeve and sliding the first tubular sleeve around the curved C-shaped body such that the first tubular cover covers the central portion of the curved C-shaped body and the first end and the second end of the curved C-shaped body remain uncovered and exposed; and wherein the first tubular sleeve is interchangeable on the curved C-shaped body with other tubular sleeves and wherein the tubular sleeves are reusable.

20. The fashion accessory of claim 19, wherein the fashion accessory is a bracelet.

* * * * *